US006161696A

United States Patent [19]

Lashley

[11] Patent Number: 6,161,696

[45] Date of Patent: Dec. 19, 2000

[54] TRANSPARENT CONTAINER AND BASE APPARATUS

[76] Inventor: Natalie Lashley, 920-17 Baychester Ave., Bronx, N.Y. 10475

[21] Appl. No.: 09/387,877

[22] Filed: Sep. 1, 1999

[51] Int. Cl.[7] ..... B65D 73/00; B65D 21/02

[52] U.S. Cl. ..... 206/477; 206/488; 206/509; 206/558; 206/528; 220/23.4

[58] Field of Search ..... 206/477, 509, 206/558, 560, 565, 538, 540, 528, 486, 488, 480; 211/74; 220/23.4, 602

[56] References Cited

U.S. PATENT DOCUMENTS

| | | | |
|---|---|---|---|
| D. 328,706 | 8/1992 | Ruff | D9/430 |
| 692,166 | 1/1902 | Schaffer | 211/74 X |
| 878,233 | 2/1908 | Paulson | 211/74 |
| 1,440,046 | 12/1922 | Ziplinsky | 206/540 X |
| 2,217,644 | 10/1940 | Conner | 220/23.4 |
| 3,369,658 | 2/1968 | Hasselmann | 220/23.4 |
| 3,467,259 | 9/1969 | Silver | 211/74 |
| 3,643,831 | 2/1972 | Casper | 220/602 X |
| 3,731,819 | 5/1973 | Sandhage | 211/74 |
| 4,038,937 | 8/1977 | Moe . | |
| 4,039,080 | 8/1977 | Cappucccilli . | |
| 4,084,695 | 4/1978 | Halbich . | |
| 4,170,082 | 10/1979 | Freedman | 220/23.4 X |
| 4,227,615 | 10/1980 | Flick | 220/602 X |
| 4,253,572 | 3/1981 | Halbich . | |
| 4,372,445 | 2/1983 | Keffler . | |
| 4,593,819 | 6/1986 | Will . | |
| 4,624,383 | 11/1986 | Moore | 220/23.4 |
| 4,749,085 | 6/1988 | Denney | 206/538 X |
| 4,757,898 | 7/1988 | Klein | 206/459.1 |
| 4,785,953 | 11/1988 | Buchholz et al. | 220/23.4 X |
| 4,793,493 | 12/1988 | Halbich . | |
| 4,889,237 | 12/1989 | Branson . | |
| 5,174,451 | 12/1992 | Niven . | |
| 5,351,818 | 10/1994 | Daneshvar . | |
| 5,409,128 | 4/1995 | Mitchell | 220/23.4 |
| 5,752,604 | 5/1998 | Hayman . | |
| 5,806,670 | 9/1998 | Harlan et al. . | |
| 5,819,940 | 10/1998 | Roulin et al. . | |

FOREIGN PATENT DOCUMENTS

| | | | |
|---|---|---|---|
| 483938 | 2/1970 | Switzerland | 206/558 |

OTHER PUBLICATIONS

"Medicine Chest" Advertisement in Daily News, Sunday, Jul. 4, 1999, p. 15.

VitaMinder, "VitaMinder Interlocking Pill Case Stackers", VitaMinder® Co., Chico, CA, Item No. 320.

Ezy Dose®, "2xL Jumbo Weekly Reminder", Apothecary Products, Inc.®, Minneapolis, MN, 1998.

*Primary Examiner*—Bryon P. Gehman

*Attorney, Agent, or Firm*—Walter J. Tencza, Jr.

[57] ABSTRACT

A base and a plurality of containers is described. The base may have a plurality of receptacles, each of the plurality of receptacles having a first dimension. Each of the plurality of containers may correspond to one of the plurality of receptacles. Each container may have a first dimension which is about the same as the first dimension of its corresponding receptacle. The base may have a top surface and each of the plurality of receptacles may be comprised of a plurality of walls, each of which extends upward from the top surface of the base. Each of the plurality of containers may have a lid which can be sealed and unsealed. The plurality of receptacles can be arranged in a plurality of rows and columns. Each of the plurality of containers may have protrusion at its top and a recess at its bottom so that a first container can be stacked on a second container. Furthermore, each of the plurality of containers may have bottom surface bounded by a plurality outer walls which define an octagonal shape and each of the plurality of receptacles may have an opening which is bounded by a plurality of walls which define an octagonal shape. In some embodiments each container may be comprised of a plurality of walls, a bottom surface, a lid, which enclose a substantially sealed chamber when the lid is in a closed position. In addition when the lid is in an opened position there is an opening at the top of the chamber and the chamber is bounded by the plurality of walls, and the bottom surface. In one embodiment the lid and the plurality of walls are substantially opaque while the bottom surface of the first container is transparent, so that an individual can see the contents inside the chamber through the bottom surface, while the opaqueness of the walls and lid prevents pills from being damaged by light.

13 Claims, 11 Drawing Sheets

TRANSPARENT CONTAINER AND BASE APPARATUS

FIELD OF THE INVENTION

The present invention relates to the field of improved methods and apparatus for storage of pills, liquids, and drugs.

BACKGROUND OF THE INVENTION

Various apparatus are known in the art to store drugs, pills, and liquids. U.S. Pat. No. 4,038,937 to Moe discloses a medicine dispenser and method. That patent shows a device which is constructed from a case 8, a tray 40, a tray insert 50, and from a plurality of slidable transparent cover strips 30. The tray insert 50 has a plurality of open compartments which are all connected together as one unit. (FIG. 1, col. 2, In. 62—col. 3, In. 40). After the device is put together, the top openings of the compartment are covered by the transparent sliding coverstrips. The bottom surface and walls of each compartment are opaque.

A product is known in the art where seven sealable plastic containers are fixed to each other for providing pills or drugs for seven days of the week. This product provides transparent or lightly tinted walls, top surface, and bottom surface which are not opaque and therefore light can damage the pills or drugs. Another product is known in the art for fixing four sealable plastic containers to each other for four times of the day. Another product is known for stacking clear plastic round containers, but this product does not provide both a lid for each round container.

DISCLOSURE DOCUMENT

A disclosure document numbered 458445, received by the patent office on Jun. 30, 1999, and filed by the inventor Natalie Lashley, described aspects of the present invention.

SUMMARY OF THE INVENTION

The present invention in one embodiment provides an apparatus comprised of a base and a plurality of containers. The base may have a plurality of receptacles, each of the plurality of receptacles having a first dimension. Each of the plurality of containers may correspond to one of the plurality of receptacles. Each container may have a first dimension which is about the same as the first dimension of its corresponding receptacle. The first dimension of each of the plurality of containers may be slightly greater or slightly less than the first dimension of its corresponding receptacle. If it is slightly greater the receptacles may need to be elastic to allow their corresponding container to come in.

The base may have a top surface and each of the plurality of receptacles may be comprised of a plurality of walls, each of which extends upward from the top surface of the base. Each of the plurality of containers may have a lid which can be sealed and unsealed. The plurality of receptacles can be arranged in a plurality of rows and columns. Each of the plurality of containers may have protrusion at its top and a recess at its bottom so that a first container can be stacked on a second container by inserting the protrusion at the top of the first container into the recess at the bottom of the second container and vice versa. Furthermore, each of the plurality of containers may have bottom surface bounded by a plurality outer walls which define an octagonal shape and each of the plurality of receptacles has an opening which is bounded by a plurality of walls which define an octagonal shape.

The base may include means for temporarily attaching each of the plurality of containers to the base which may be comprised of the receptacles.

In one embodiment each container may be comprised of a plurality of walls, a bottom surface, a lid, wherein the plurality of walls, bottom surface, and lid enclose a substantially sealed chamber when the lid is in a closed position. In addition when each lid is in an opened position there is an opening at the top of each chamber of each container, wherein the top of each chamber is opposite each bottom surface, and each chamber is bounded by the plurality of walls, and the bottom surface. In this embodiment each lid and each set of plurality of walls are substantially opaque while each bottom surface of each container is transparent, so that an individual can see the contents inside each chamber through each bottom surface. In addition, if a base is included for attaching the containers to, the base may be transparent to again allow an individual to see the contents inside each chamber of each container. The opaqueness of the walls and lid prevents pills from being damaged by light when the container is in an upright position.

In some embodiments four rows of seven columns of containers for a total of twenty-eight containers are provided for attaching to a base. In one embodiment a single row of seven containers is provided for attaching to an elongated base. In some embodiments the base for attaching the containers to may be transparent in other embodiments the base may have openings in order to allow an individual to see the contents of containers. The container lid in some embodiments may be of a snap on type. In other embodiments, the container lid may be of a screw on type or of some other known type.

The present invention allows people to pocket an individual container or individual containers and use the contents at any time and at any location. Previous devices, such as shown in U.S. Pat. No. 4,038,937 could not be placed in the pocket and used in any location. In some embodiments the present invention allows containers to be either connected horizontally (by being connected to a base assembly) or connected vertically by being stacked one on top) of another. This allows any desired regimen of use to be implemented as an individual so determines. Prior devices typically have one manner of connecting such as stacking or being connected horizontally and also are not typically removable or detachable. This designates a set regimen for use. An individual cannot vary a regimen as based upon a modified need.

Further objects and advantages of my invention will become apparent from a consideration of the drawings and ensuing specification.

DETAILED DESCRIPTION OF THE DRAWINGS

Figure 1:
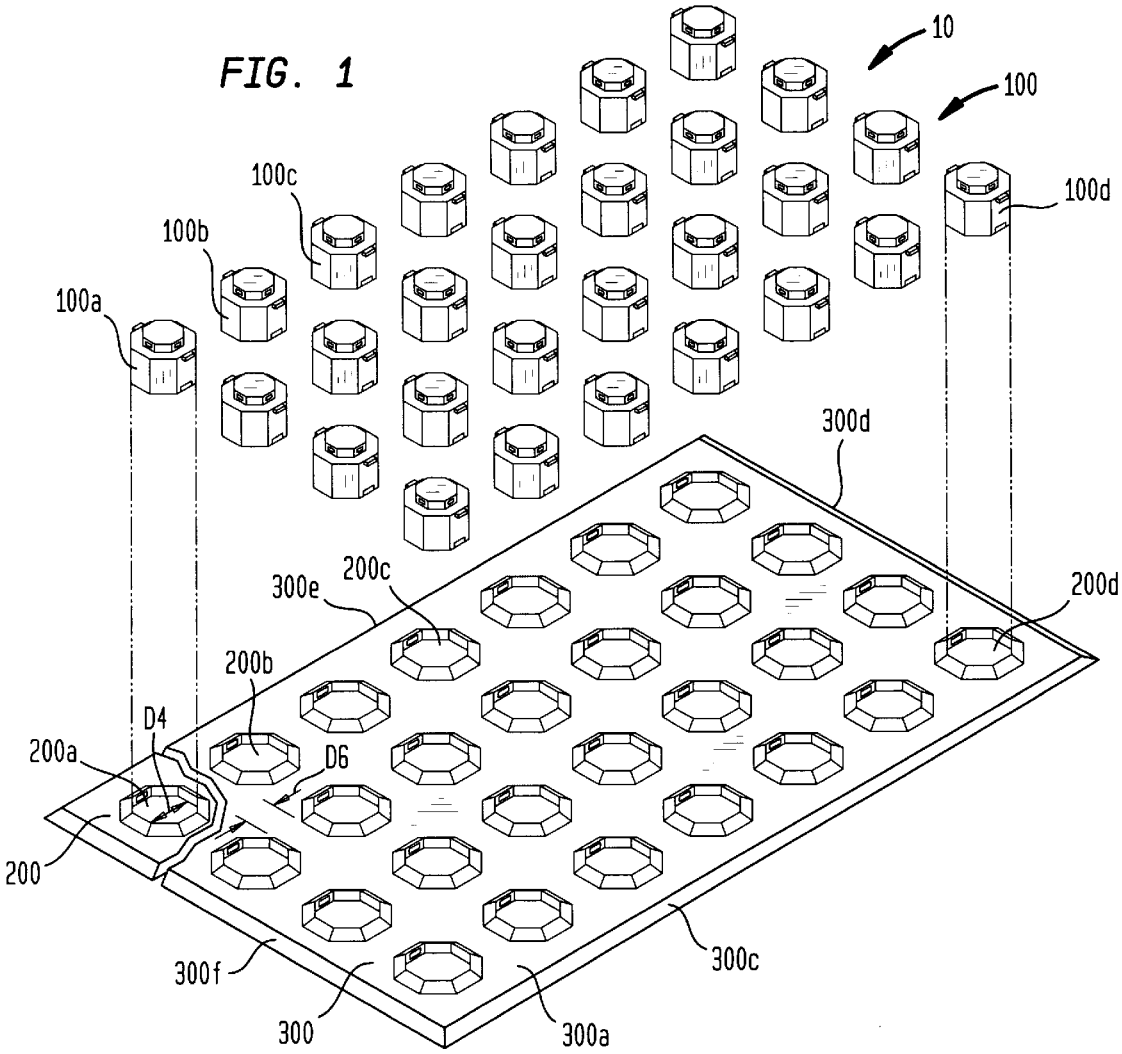
FIG. 1 is a perspective view of a plurality containers and a base assembly in accordance with an embodiment of the present invention with the plurality of containers separated from the base assembly with part of the base assembly shown cutaway.

FIG. 1 is a perspective view of an apparatus 10 comprised of a plurality containers 100 and a base assembly 300 in accordance with an embodiment of the present invention with the plurality of containers 100 separated from the base assembly 300 and with part of the base assembly 300 shown cutaway.

The plurality of containers 100 include twenty-eight containers in FIG. 1. Containers 100*a*, 100*b*, 100*c*, and 100*d* are specifically identified in FIG. 1. The base assembly 300 has a front 300*c*, sides 300*d* and 300*f*, and a back 300*e*. The base assembly has a plurality of receptacles 200, one for each of the plurality of containers 100, each receptacle being able to receive and hold its respective container. The receptacles 200 include receptacles 200*a*, 200*b*, 200*c*, and 200*d* which are specifically identified in FIG. 1. The base assembly 300 includes a top surface 300*a*.

Figure 2:
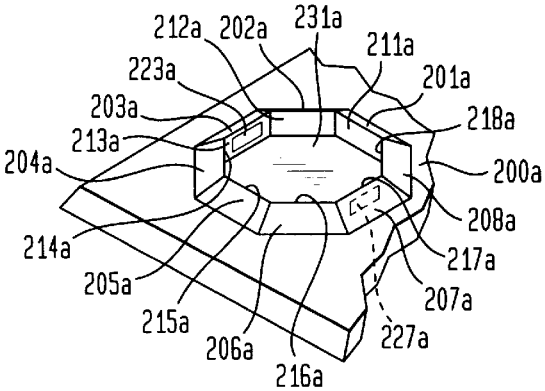
FIG. 2 is a cutaway view of a portion of the base assembly of FIG. 1.

FIG. 2 is a cutaway view of a portion of the base assembly 300 of FIG. 1. In FIG. 2 the details of the receptacle 200*a* are shown. The receptacle 200*a* includes outer walls 201*a* through 208*a*, inner walls 211*a* through 218*a*, bottom surface 231*a*, and protrusion 223*a* and 227*a*. The outer walls 201*a* through 208*a* form an octagon and the inner walls 211*a* through 218*a* also form an octagon. The shortest distance, D4, shown in FIG. 1, between the inner walls 215*a* and 211*a* of the receptacle 200*a* is preferably slightly greater than the distance, D3, shown in FIG. 9 between the outer part of opposing outer walls (such as walls 104*a* and 108*a*) of the container 100*a*. The distance D3 may be 1 and ¾ inches. The height of the container which would be from the bottom of, for example, wall 102*a* to the top of octagon portion wall 141*a*, with the lid 110*a* closed could be 1 and 3/16 inches (see FIGS. 6 and 7). The height, H1 of the wall 102*a*, shown in FIG. 7, may be ⅞ inches. The shortest distance between inner walls 216*a* and 212*a*, between 217*a* and 213*a*, and between 218*a* and 214*a* should also be D4 in this example, so that the shape is uniform.

The receptacle walls, such as walls 201*a* through 208*a* shown in FIG. 2, may rise ½ inch above the top surface 300*a* of the base 300. There may be a distance of D6, shown in FIG. 1, of ¾ inch between receptacles, such as between receptacle 200*a* and 200*b*.

Figure 3:
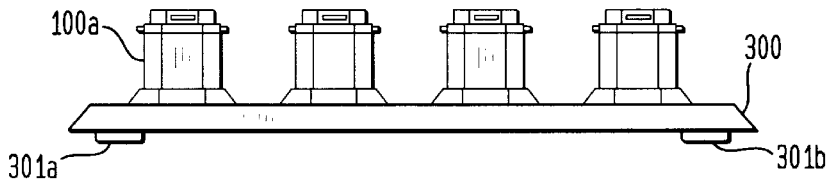
FIG. 3 is a side view of the plurality of containers and base assembly of FIG. 1 attached together.

FIG. 3 is a side view of the plurality of containers 100 and base assembly 300 of FIG. 1 attached together. Container 100*a* is identified. Also shown is leg 301*a* and leg 301*b* which are attached to the base assembly 300.

Figure 4:
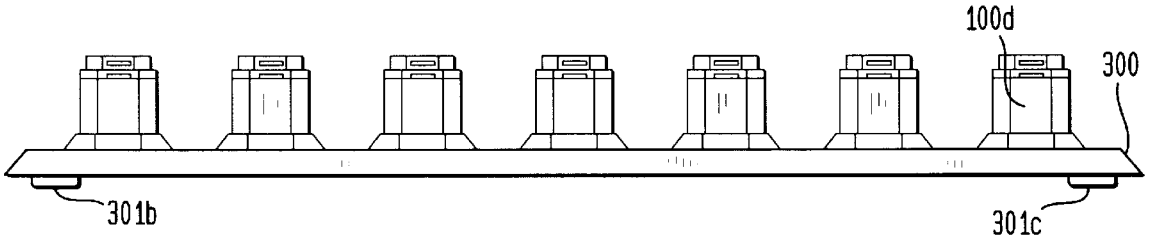
FIG. 4 is a front view of the plurality of containers and base assembly of FIG. 1 attached together.

FIG. 4 is a front view of the plurality of containers 100 and base assembly 300 of FIG. 1 attached together. Container 100*d* is identified. Also shown is leg 301*b* and leg 301*c* which are attached to the base assembly 300.

Figure 5:
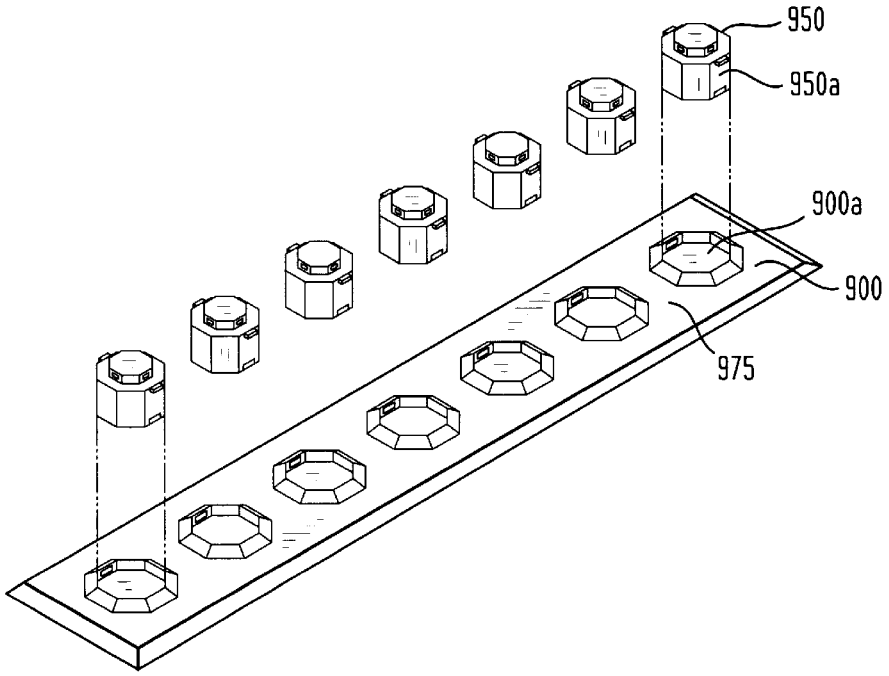
FIG. 5 is a perspective view of another embodiment of a plurality of containers and a base assembly in accordance with the present invention, with the containers shown separated from the base assembly.

FIG. 5 is a perspective view of a plurality of containers 950 and a base assembly 975 in accordance with another embodiment of the present invention, with the containers 950 shown separated from the base assembly 975. The containers 950 include container 950*a* which may be the same as container 100*a* of FIG. 1. The base assembly 975 includes receptacles 900 which include receptacle 900*a*. Receptacle 900*a* may be the same as receptacle 200*a* of FIG. 1. In the embodiment of FIG. 5 a single row of seven containers is provided for attaching to an elongated base assembly 975.

Figure 6:
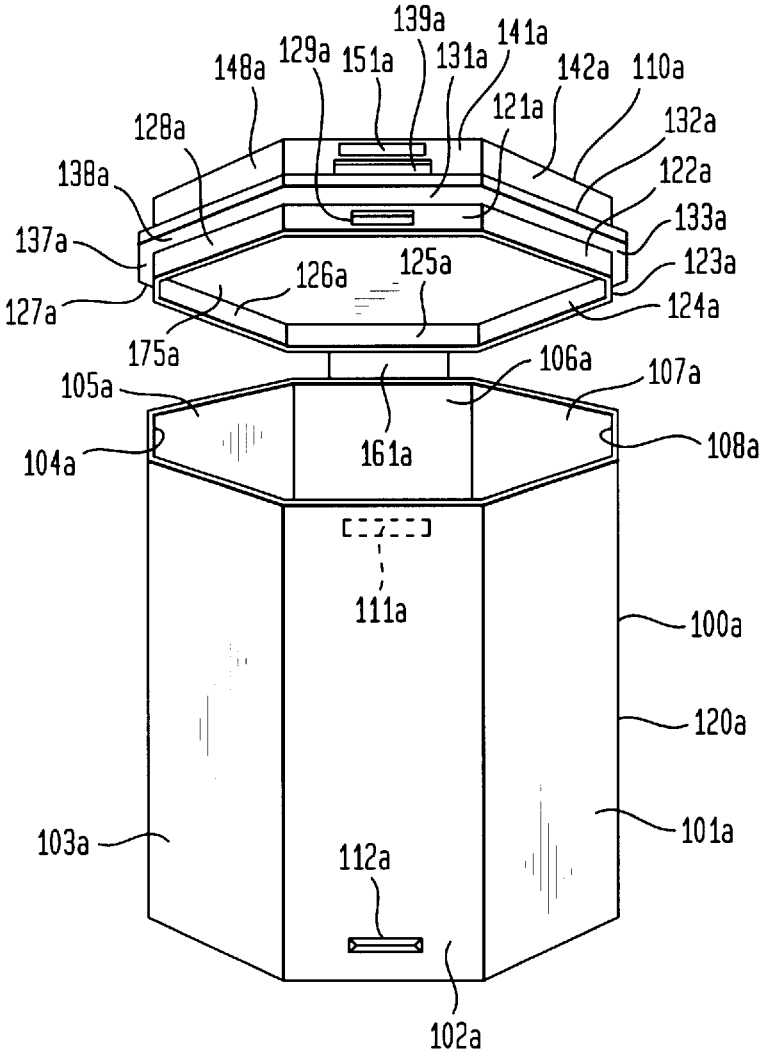
FIG. 6 is a front perspective view of one of the plurality of containers for use in the FIG. 1 embodiment, with the lid of the container in an opened position.

FIG. 6 is a front perspective view of the container 100*a* for use in the FIG. 1 and FIG. 5 embodiments, with the lid of the container in an opened position. The container 100*a* includes lid 110*a* and body portion 120*a*. The lid 110*a* is attached to the body portion 120*a* by a connection piece 161*a*. The container 100*a* can be thought of as part of a unit. It is possible that several containers could be attached together in a single unit, although in this embodiment a unit includes only a single container, such as container 100*a*.

Figure 11:
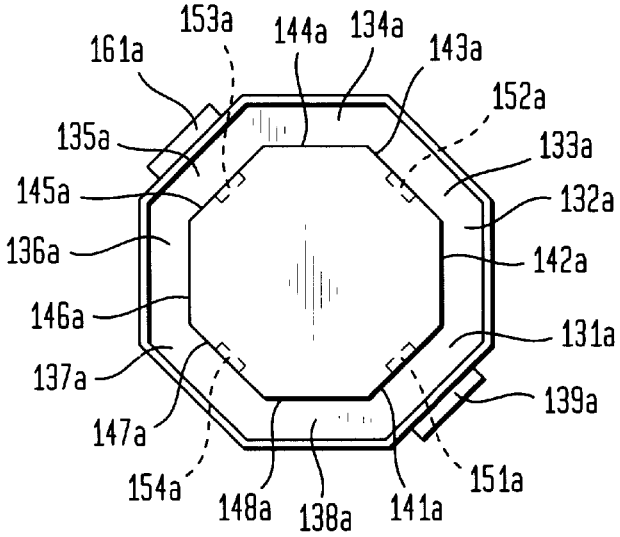
FIG. 11 is a top view of the top of the lid of the container of FIG. 6.

The lid 110*a* includes a top level octagon portion comprised of walls 141*a* through 148*a*. The top level octagon portion comprised of 141*a* through 148*a* can be seen by referring to FIGS. 6, 11, 12, and 13. The top level octagon portion 167*a* (defined by 141*a* through 148*a*) can also be thought of as a protrusion for inserting into a bottom recess (the same form as recess; 166*a* shown in FIG. 12, which is defined by bottom surface 162*a* and walls 401*a* through 408*a*) of another container for stacking. Recesses 151*a* through 154*a* are also located on the top level octagon portion. As shown in FIG. 11, recesses 151*a* through 154*a* are located in the walls 141*a*, 143*a*, 145*a*, and 147*a*, respectively.

Figure 9:
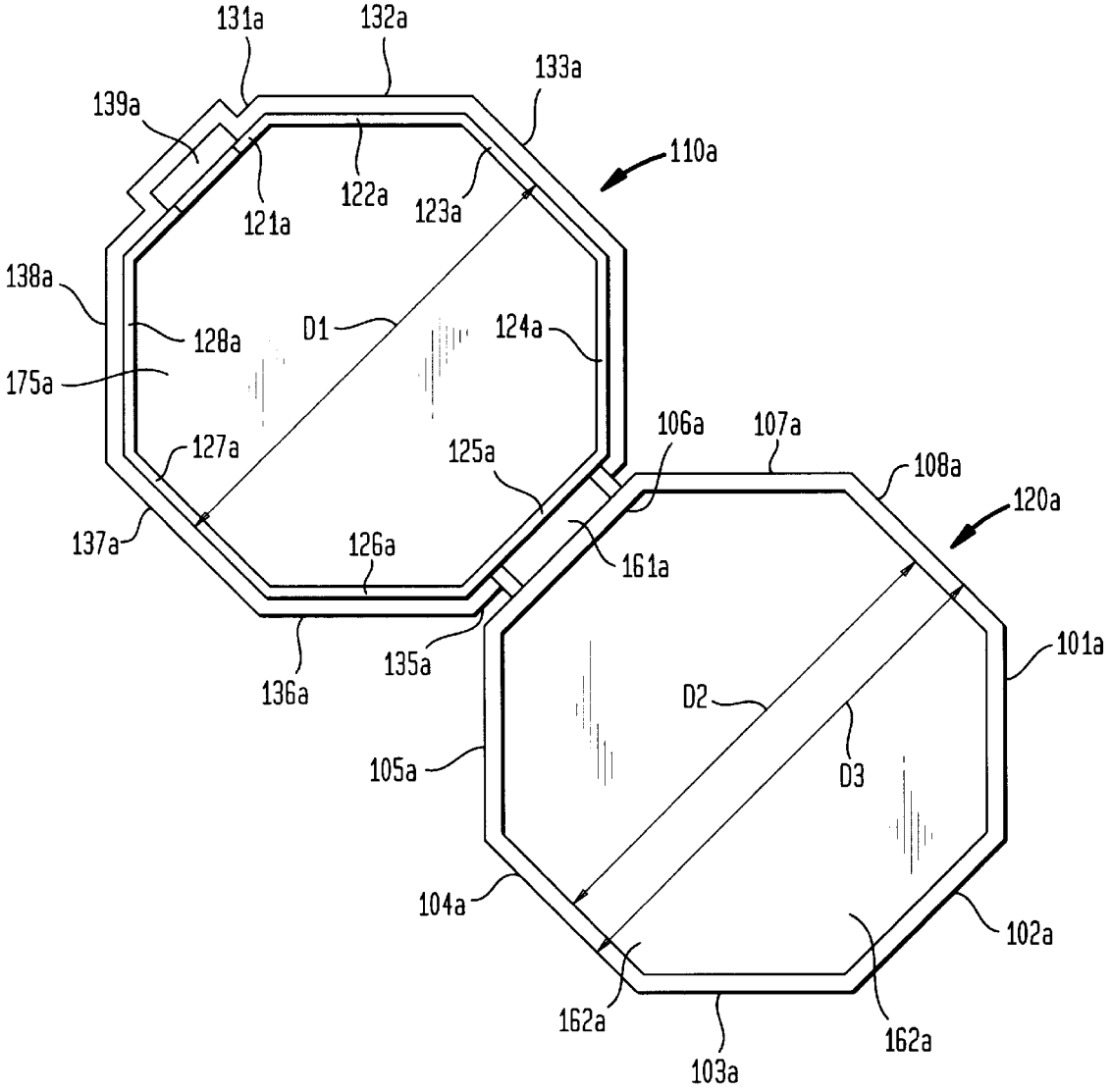
FIG. 9 is a top view looking downwards on the opened lid and the opened container of the container of FIG. 6.

The lid 110*a* also includes a second level octagon portion comprised of flanges 131*a* through 138*a* as shown in FIGS. 6, 9, 10, 11, and 12. The flange 131*a* has connected to it a pull tab 139 as shown in FIG. 6. The lid 110 includes a third level octagon portion comprised of walls 121*a* through 128*a*. The wall 121*a* has a protrusion 129*a* located at its center. As shown in FIG. 9, the lid 110*a* has an under surface 175*a*.

Figure 10:
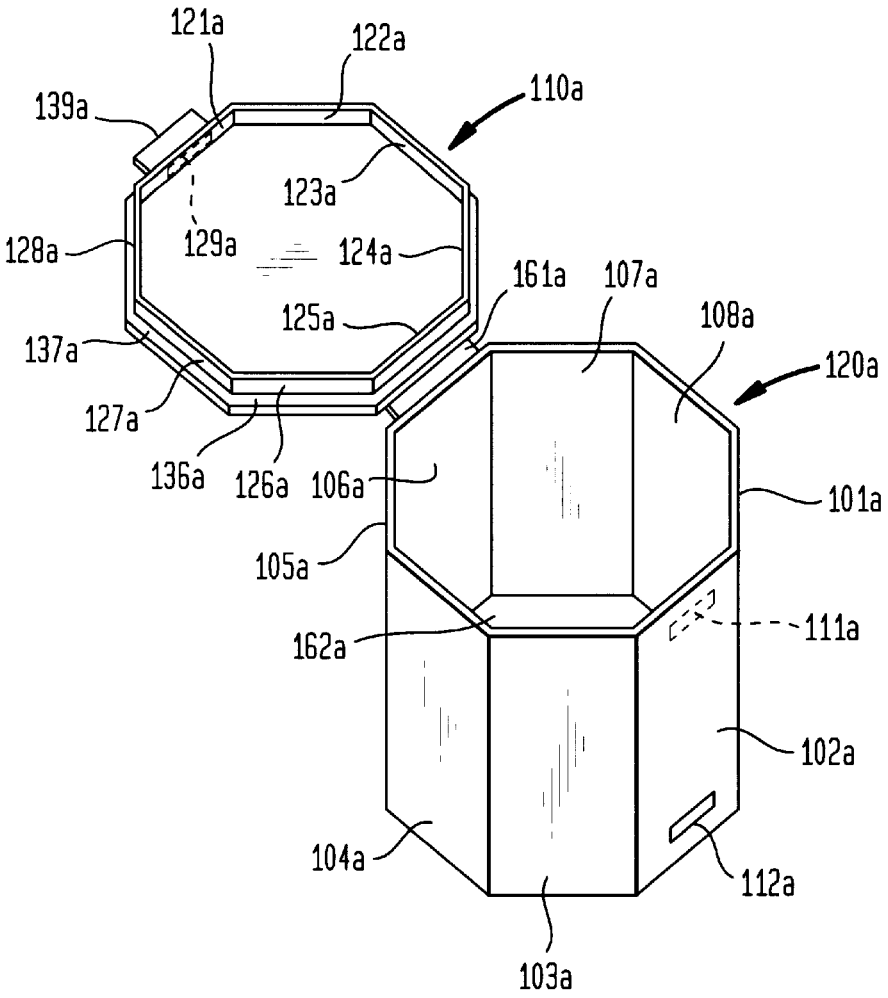
FIG. 10 is a perspective view of the container of FIG. 6 with the lid opened and the inside of the container visible.

The body portion 120*a* of the container 100*a* includes walls 101*a* through 108*a* as shown in FIGS. 6, 9, and 10. The body portion 120*a* also includes a bottom 162*a* shown in FIGS. 9, 10, and 12. Wall 102*a* includes a recess 111*a* on its internal surface shown in FIG. 7. Wall 102*a* also includes a recess 112*a* on its outer surface shown in FIG. 6. Wall 106*a* includes a recess 113*a* on its outer surface, the general location of which is shown in phantom lines in FIG. 8, recess 113*a* is in a similar location to recess 112*a* shown in FIG. 6.

The body portion 120*a* also includes a large octagonal recess 166*a* at its bottom. The recess 166*a* can best be seen in FIG. 12. The bottom of the body portion 120*a* is defined by bottom surfaces 181*a* through 188*a*. Bottom surfaces 181*a* through 188*a* are joined to walls 401*a* through 408*a* respectively by beveled surfaces 191*a* through 198*a*, respectively. The walls 401*a* through 408*a* actually form the recess at the bottom the portion 120*a*. The central bottom surface 162*a* provides a closed and sealed structure inside the body portion 120*a*. The recess at the bottom of body portion 120*a* includes protrusions 172*a*, 174*a*, 176*a*, and 178*a* which extend outward from walls 402*a*, 404*a*, 406*a*, and 408*a*. The large octagonal recess 166*a* at the bottom of body portion 120*a* has internal dimensions and is of a shape so that a container, such as container 100*b*, which is in the same form as container 100*a*, can fit its top level octagon portion or protrusion defined by walls 141*b* through 148*b* (not shown but the same form as portion 167*a* defined by walls 141*a* through 148*a*) inside the large octagonal recess 166*a* at the bottom of the body portion 120*a*. Container 100*a* is shown stacked on top of container 100*b* in FIG. 13. The protrusions 172*a*, 174*a*, 176*a*, and 178*a* of the container 100*a* fit into the recesses of the container 100*b* at its top level octagon (i.e. the same form as recesses 151*a*, 154*a*, 153*a*, and 152*a* shown for container 100*a*) when the container 100*a* is stacked on top of the container 100*b* as shown in FIG. 13.

The lid 110*a* of the container 100*a* is shown open in FIG. 6. When the lid 110*a* is closed, the protrusion 129*a* fits inside the recess 111*a* so that the lid 110*a* is held closed until a sufficient amount of force is applied to pull tab 139 to cause the lid 110*a* to open.

The walls 121*a* through 128*a* of the lid 110*a* fit inside the walls 102*a*, 108*a*, 107*a*, 106*a*, 105*a*, 104*a*, and 103*a* of the body portion 120*a* respectively. The closest distance D1 between the outer surfaces of opposing walls 127*a* and 123*a*, shown in FIG. 9, is slightly less than the closest distance D2 between the inner surfaces of walls 104*a* and 108*a*, shown in FIG. 9. The shortest distances between outer surfaces of opposing walls 128*a* and 124*a*, 121*a* and 125*a*, 122*a* and 126*a* is also D1 and the shortest distances between the inner surfaces of walls 103*a* and 107*a*, 101*a* and 105*a*, and 102*a* and 106*a* is also D2. In this manner the walls 121*a* through 128*a* fit snugly within the walls 101*a* through 108*a*.

The flanges 131*a* through 138*a* fit on top of the walls 102*a*, 101*a*, 108*a*, 107*a*, 106*a*, 105*a*, 104*a*, and 103*a*, respectively and this allows the lid 110*a* to seal and close the body portion 120*a*. When closed the container 100*a* has a closed chamber bounded by lid 110*a* under surface 175*a*, , walls 101*a* through 108*a*, bottom surface 162*a*, and closed off by the combination of walls 121*a* through 128*a* and flanges 131*a* through 138*a*.

Figure 7:
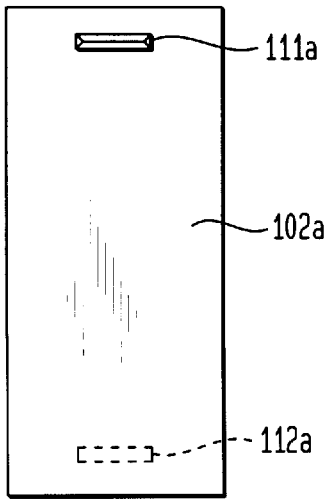
FIG. 7 is an inside view of the front surface of the body of the container of FIG. 6.

FIG. 7 is an inside view of the front surface 102*a* of the body 120*a* of the container 100*a* of FIG. 6. The recess 111*a* is shown for inserting the protrusion 129*a* of the lid 110*a*. The location of the recess 112*a* is shown for inserting the container 100*a* into the receptacle 200*a*, so that protrusion 227*a* shown in FIG. 2 is inserted into recess 112*a* to hold the container 100*a* to the base assembly 300.

Figure 8:
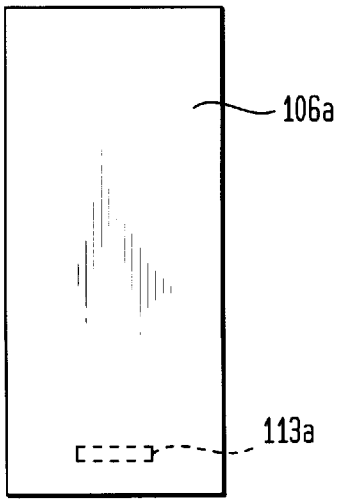
FIG. 8 is an inside view of the back surface of the body of the container of FIG. 6.

FIG. 8 is an inside view of the back surface 106*a* of the body portion 120*a* of the container 100*a* of FIG. 6. The location of the recess 113*a* is shown, into which the protrusion 223*a* can be inserted in order to hold the container 100*a* in the receptacle 200*a* and to the base assembly 300.

FIG. 9 is a top view looking downward on the opened lid 110*a* and the opened body portion 120*a* of the container 100*a* of FIG. 1. The various portions of the diagram have been described previously.

FIG. 10 is a perspective view of the container 100*a* of FIG. 1 with the lid 110*a* opened and the inside of the body portion 120*a* of the container 100*a* visible.

FIG. 11 is a top view of the top of the lid 110*a* of the container 100*a* of FIG. 6.

Figure 12:
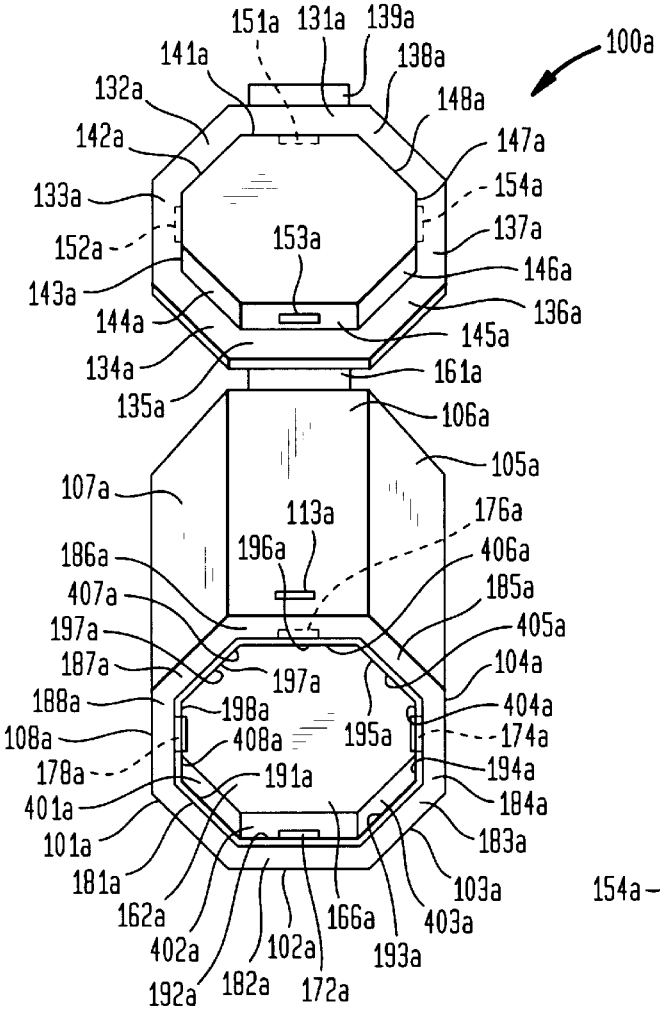
FIG. 12 is a rear perspective view of the container of FIG. 6 with the lid open.
Figure 13:
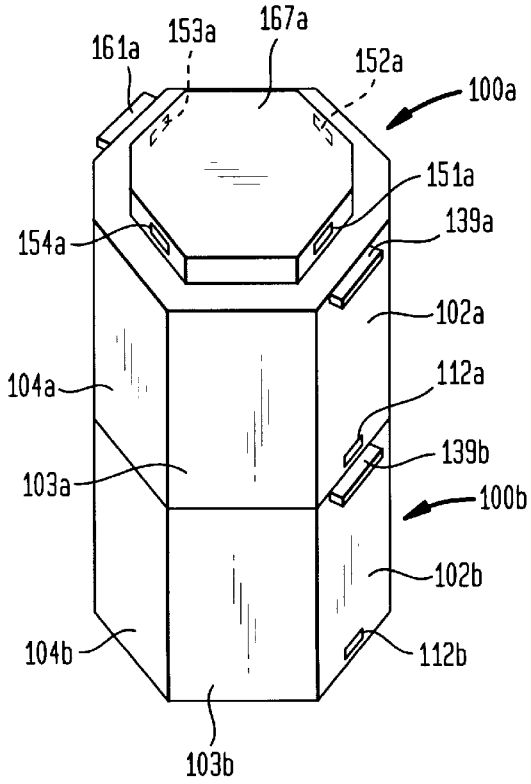
FIG. 13 is a perspective view of two containers of FIG. 1 stacked on top of one another.

FIG. 12 is a rear perspective view of the container 100*a* of FIG. 6 with the lid 110*a* open. The features of this diagram have been described.

FIG. 13 is a perspective view two containers 100*a* and 100*b* of FIG. 1 stacked on top of one another. The features of this diagram have been described.

Figure 14:
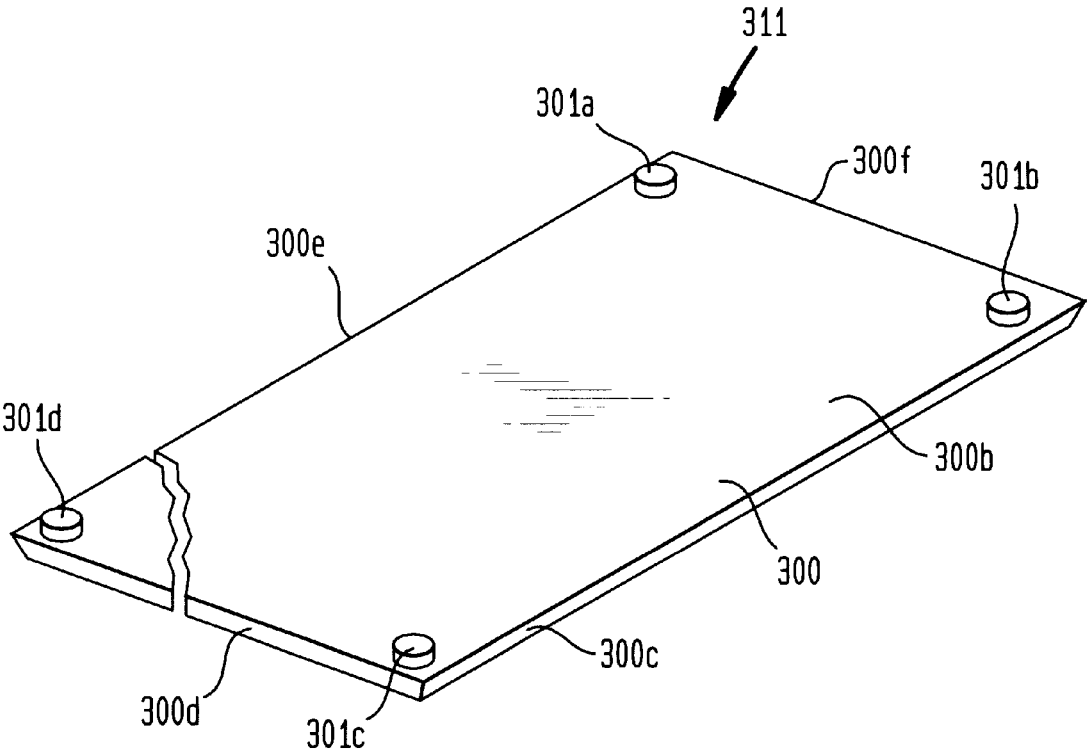
FIG. 14 is a perspective view of the bottom of the base assembly of FIG. 1 with part of the base assembly cut away.
Figure 15:
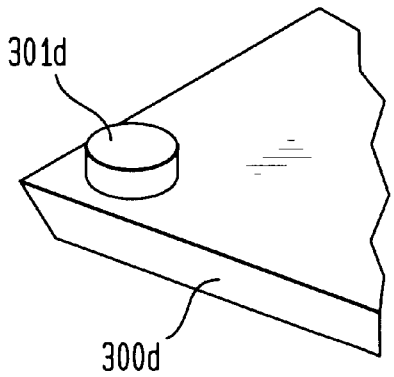
FIG. 15 is a perspective view of the cutaway section of the base assembly shown in FIG. 14.

FIG. 14 is a perspective view of the bottom of the base assembly 300 of FIG. 1 with part of the base assembly 300 cut away. The base assembly 300 includes bottom legs 301*a* through 301*d*. FIG. 15 is a perspective view of the cutaway section of the base assembly 300 shown in FIG. 14.

Figure 16:
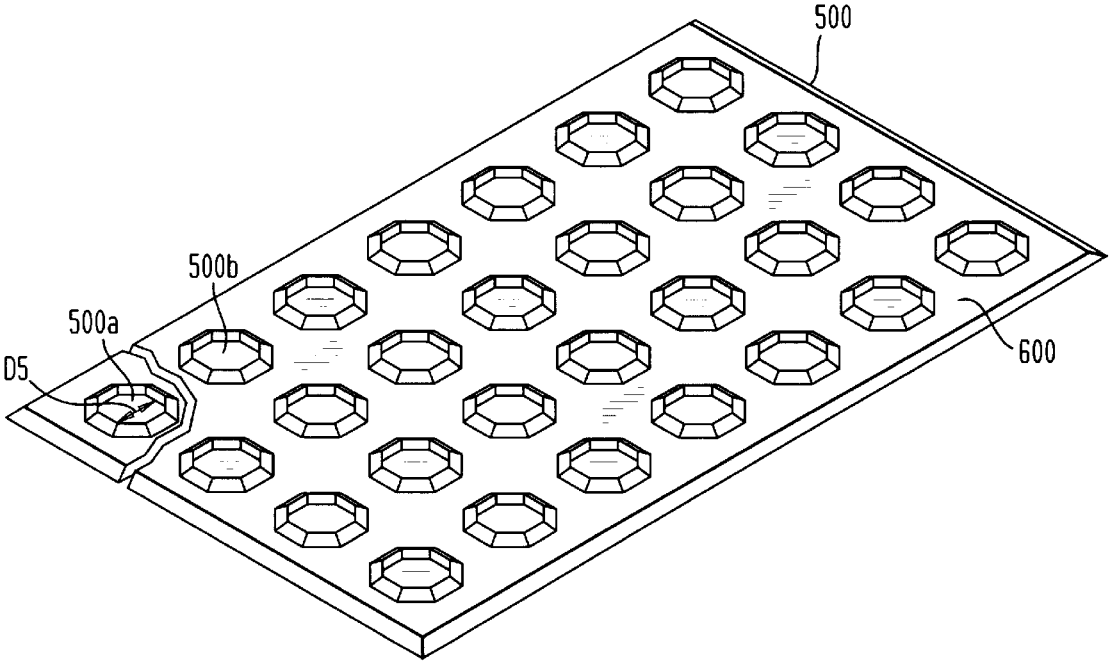
FIG. 16 is a perspective view of the top of another base assembly in accordance with another embodiment of the present invention with part of the base assembly shown cutaway.
Figure 17:
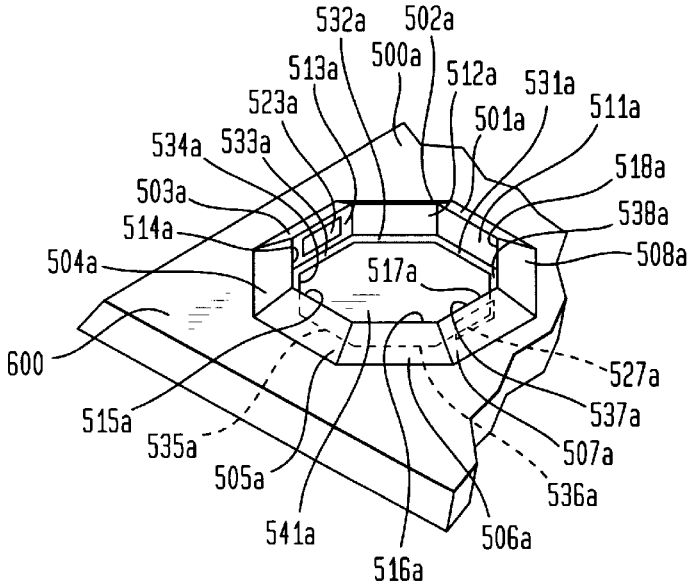
FIG. 17 shows the cutaway section shown in FIG. 16.

FIG. 16 is a perspective view of the top of a base assembly 600 in accordance with another embodiment of the present invention with part of the base assembly 600 shown cutaway. FIG. 17 shows the cutaway section shown in FIG. 16. The base assembly 600 is the same as the base assembly 300 shown in FIG. 1 except that each receptacle of a plurality of receptacles 500 has a octagonal opening. FIG. 16 shows receptacles 500*a* and 500*b* of the plurality of receptacles 500. Receptacle 500*a* is shown in detail in FIG. 17. Receptacle 500*a* includes outer walls 501*a* through 508*a* and inner walls 511*a* through 518*a*. The receptacle 500*a* also includes fringe surfaces 531*a* through 538*a*. The receptacle also includes protrusions 527*a* and 523*a* which have a function and are analogous to protrusions 227*a* and 223*a* shown in FIG. 2. The receptacle 500*a* also includes octagonal opening 541*a*. A container, such as container 100*a* of FIG. 1, can be inserted into receptacle 500*a* so that recesses 112*a* and 113*a* (shown in FIGS. 6–8) have the protrusions 523*a* and 527*a* inserted into them, respectively. However, unlike the surface 231*a* of FIG. 2, the receptacle 500*a* has a central opening 541*a* and only outer fringe surfaces 531*a* through 538*a*.

The bottoms of the walls 101*a* through 108*a* of the container body 120*a* can come in contact with the fringe surfaces 538*a*, 537*a*, 536*a*, 535*a*, 534*a*, 533*a*, 532*a*, and 531*a* respectively, which helps to prevent the container 100*a* from falling through the opening 541*a*. In addition the closest distance, D5, shown in FIG. 16 between the opposing fringe surfaces 535*a* and 531*a* is preferably less than the closest distance, D3, between the opposing walls 104*a* and 108*a* (shown in FIG. 9). In this way the container 100*a* won't fall through the opening 541*a*. The opening 541*a* is used in conjunction with a transparent bottom 162*a* of the container 100*a* so that an individual can view the contents of the container 100*a*, i.e. see what color it is or some other characteristic.

Figure 18:
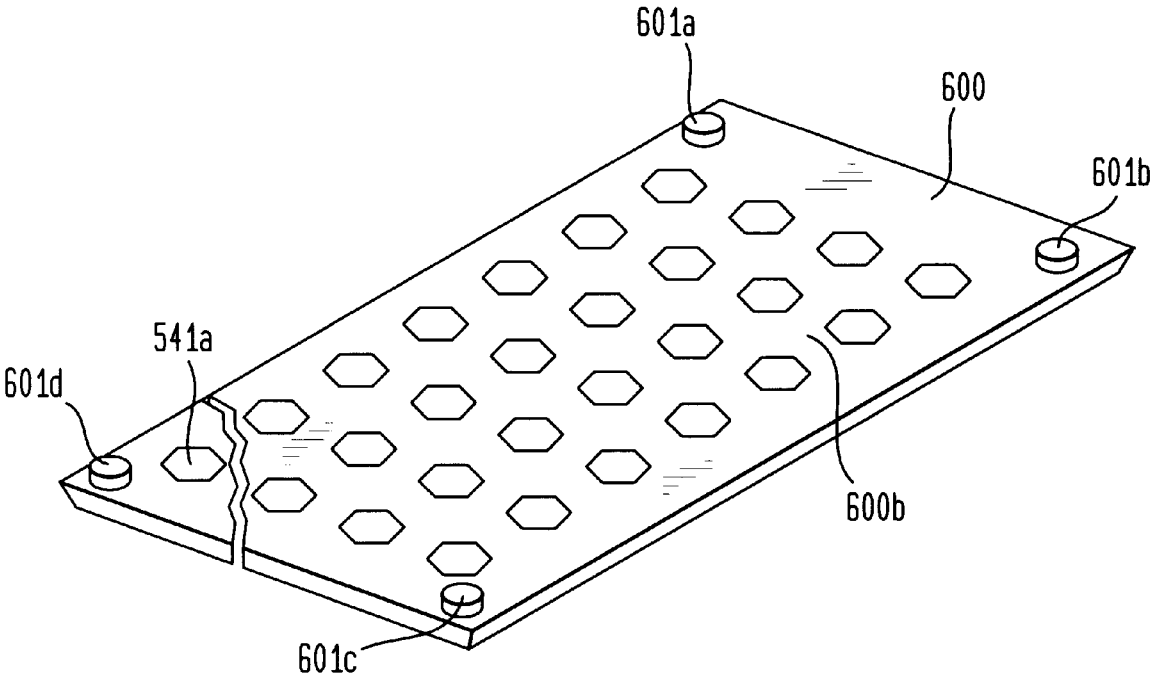
FIG. 18 is a perspective view of the bottom on the base assembly in FIG. 16 with part of the base assembly shown cutaway.
Figure 19:
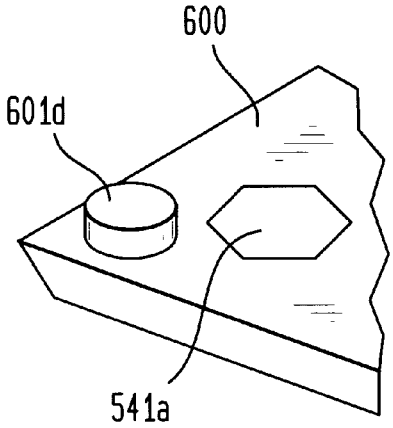
FIG. 19 shows the cutaway section shown in FIG. 18.

FIG. 18 is a perspective view of the bottom on the base assembly 600 in FIG. 16 with part of the base assembly 600 shown cutaway. FIG. 19 shows the cutaway section shown in FIG. 18. Legs 601*a–d* are shown. The opening 541*a* is identified.

Figure 20:
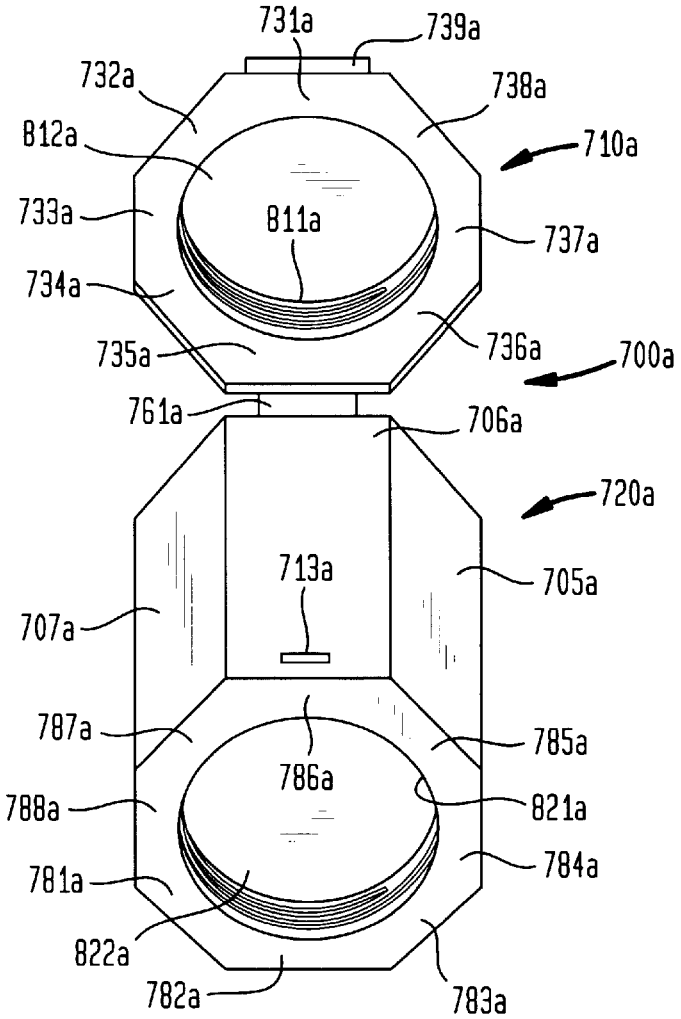
FIG. 20 is a rear perspective view of a container in accordance with another embodiment of the present invention where mounting is done by screwing one container on top of another.
Figure 21:
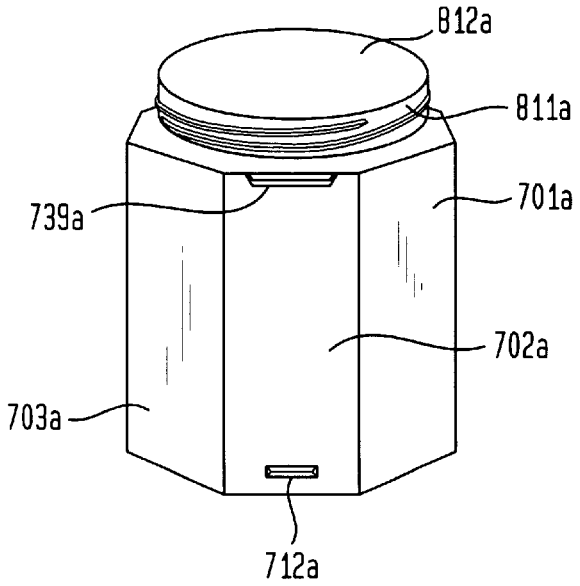
FIG. 21 is a front perspective view of the container of FIG. 20.
Figure 22:
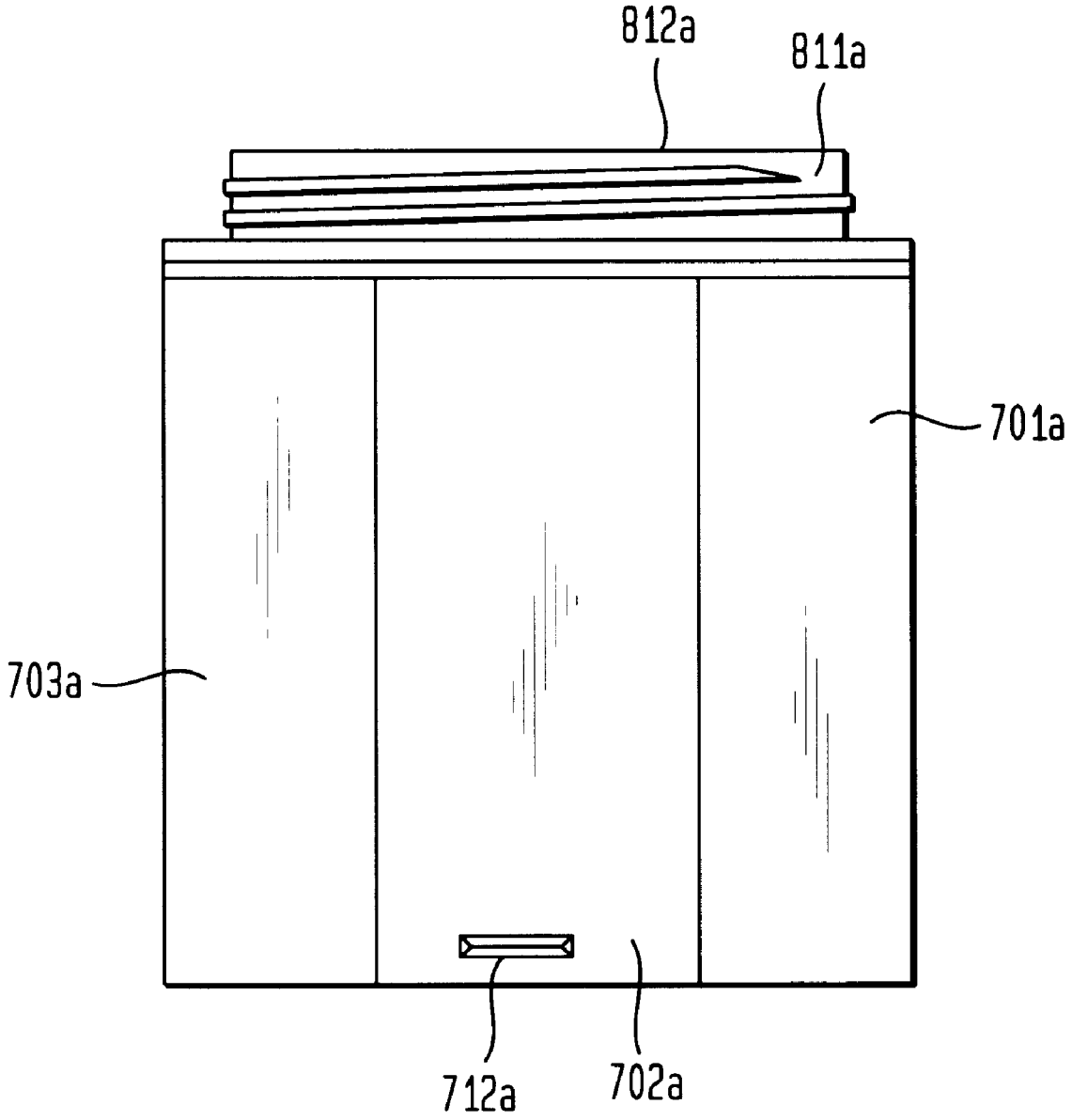
FIG. 22 is a front view of the container of FIG. 20.

FIG. 20 is a rear perspective view of a container 700*a* in accordance with another embodiment of the present invention where mounting is done by screwing one container 700*a* on top of another container of the same form. FIG. 21 is a front perspective view of the container 700*a* of FIG. 20; and FIG. 22 is a front view of the container 700*a* of FIG. 20. FIG. 20 shows walls 701*a* through 708*a* for body portion 720*a* similar to body portion 120*a* of container 100*a*. Instead of an octagonal recess with protrusions as in FIG. 12, the container 700*a* has a circular recess 822*a* with threads 821*a*. The container 700*a* also has bottom surfaces 781*a* through 787*a* and a recess 713*a* for inserting a protrusion such as protrusion 523*a* of the base assembly 600 into. There is a similar recess 712*a* for inserting the protrusion 527*a* into, to hold the container 700*a* to the base assembly 500, for example. The container 700*a* has a connection piece 761*a*, flanges 731*a* through 738*a*, and pull tab 739*a*. The lid 710*a* has a circular region 812*a* on its top which has threads 811*a*. The top circular region 812*a* can be screwed into the bottom region of a similarly formed container (i.e. a bottom region similar to 822*a*), to stack the containers one on top of each other so that they are held in place.

All parts of present invention can be transparent. However, it is preferable in one embodiment that all parts of the containers 100 such as container 100*a* be opaque (not transparent) and colored, except for the bottom surface such as 162*a* of the body portion 120*a*. Having the container 100*a* opaque, not transparent, and colored, protects pills and tablets from the effect of heat and light. Having the bottom surface 162*a* transparent allows one to see inside the container to see the color of the contents or some other characteristic of what is inside.

It is preferable that the base 300 be transparent including the receptacles 200, such as receptacle 200*a*, and bottom extended circular stub legs 301*a* through 301*d*. Transparency of the base assembly 300 and the bottom side of octagonal containers 100 (such as surface 162*a*) allows persons to quickly view contents by flipping the entire assembled container apparatus 10 shown in FIG. 1 upside down.

The base 300, including extended stub legs 301*a* through 301*d* and the inner and outer walls of receptacles 200, is preferably formed and integrally molded from plastic. The containers 100 are similarly so formed. The lids of the containers 100 such as lid 110*a* are similarly so formed and molded together with the container 100*a* and as a separate assembly and pressed together in permanent fashion.

The circular stubs 301*a* through 301*d* may be made of rubber or some material which is less likely to scratch a table top surface. Each stub, such as stub 301*a* can be located ¾ of an inch from each corner angle, such as corner 311 shown in FIG. 14. The four stubs 301*a* through 301*d* form four legs for the base assembly 300. The base assembly 300 may be placed on a table top which may be made of glass wood, or any other known material.

Each container of containers 100 can be used to store pills, tablets, liquids, paints, or any other possible material. Container lids, such as lid 110*a* snap shut to close. Each lid such as lid 110*a*, should be snug fit, providing individual airtight compartments to maintain storage of pills and tablets or liquids. Each container of containers 100 can connect to another of containers 100 by a snap fit method as previously described.

Each inner wall, such as inner wall 211*a* may extend ¼ (one quarter) of an inch off the top surface 300*a* of the base assembly 300 shown by FIGS. 1 and 2. In some cases D3, the outer width of the container 100*a* may actually be slightly larger than D4, the width of the distance between the inner walls of the receptacle 200*a* and the receptacle 200*a* walls 201*a*–208*a*, and 211*a* through 218*a* may be elastic and may stretch to allow the container 100*a* to snugly fit within the receptacle 200*a*. Other manners of inserting a container into a receptacle which allow the receptacle to be removed and allow the receptacle to fit snugly may be used.

Each receptacle 200, such as receptacle 200*a*, is spaced approximately a distance D6, which may be ¾ of an inch from a neighboring receptacle. For example receptacle 200*a* may be spaced a distance D6, shown in FIG. 2, from receptacle 200*b*. this allows adequate spacing so that an individual's fingers can be positioned within the space to manually remove each container of containers 100. The same ¾ inch spacing may exist at the side and end borders of the base 300, i.e. there may be a spacing of D6 inches from the receptacle 200*a* to the end 300*f* of the top surface 300*a* of the base assembly 300.

The present invention in various embodiments has many advantages. Some embodiments allow pills to be administered quickly once stocked. The twenty-eight container embodiment allows may pills to be stocked. The embodiment of FIG. 1 could be used for a one a day administration of pills for a twenty-eight day supply or a four a day administration of pills for a seven day supply.

An important feature is the mobility feature, i.e. the fact that any container, such as container 100*a* can be dislodged or separated from the base 300 and carried in a purse or pocket if a person for example is going on a vacation. The stacking feature allows containers to be connected to one another and to carry any number desired in purse or pocket. The snap fit lid, such as lid 110*a* allows any container to open and close quickly. The snap fit contact in some embodiments between raised walls such as walls 201*a* through 208*a* on base 300 and container 100*a* means any container can be quickly lodged and dislodged from the base. The snap fit contact between individual containers means they can be lodged and dislodged from each other when stacked and unstacked. Any container can be reached quickly in the embodiments of FIGS. 1, 5, and 16. All containers 100 are visibly displayed making each easily and quickly reached without need to assemble or disassemble. The transparent or open hole underside allows one to observe contents without opening individual containers. The base 300 may be entirely made of transparent material. The containers 100 could be transparent plastic but preferably there is opaque plastic for the walls 101*a*–108*a* and the lid 110 and transparent plastic for the bottom 162*a*.

The present invention in some embodiments allows people to pocket an individual container or individual containers and use the contents at any time and at any location. Previous devices, such as shown in U.S. Pat. No. 4,038,937 could not be placed in the pocket and used in any location. In some embodiments the present invention allows containers to be either connected horizontally (by being connected to a base assembly) or connected vertically by being stacked one on top of another. This allows any desired regimen of use to be implemented as an individual so determines. Prior devices typically have one manner of connecting such as stacking or being connected horizontally and also are not typically removable or detachable. This designates a set regimen for use. An individual cannot vary a regimen as based upon a modified need in these prior devices.

The apparatus of FIG. 1 can be used to house artist's paints, as a pill container to store pills and tablets, and to store contact lenses. It can also be used to house make up shades of various colors and hues. It can be used for house samplings of any kind, to store adhesives, to store hand creams, to house liquids used in industry, and to store lubricants.

Any changes, modifications, variations, other used and applications that do not depart from the spirit and scope of this invention are considered to be covered by this invention.

I claim:

1. An apparatus comprised of:

a first container which is comprised of:
a plurality of walls
a bottom surface;
a lid;

wherein the plurality of walls, bottom surface, and lid enclose a substantially sealed chamber when the lid is in a closed position;

wherein when the lid is in an opened position there is an opening at the top of the chamber, wherein the top of the chamber is opposite the bottom surface, and the chamber is bounded by the plurality of walls, and the bottom surface, wherein the lid and the plurality of walls are substantially opaque;

wherein the bottom surface of the first container is transparent, so that an individual can see inside the chamber through the bottom surface;and further comprised of a base for attaching the first container to;

wherein the first container includes an attachment device and the base includes an attachment device;

and the base is transparent so that an individual can see through the base and through the bottom surface of the first container and thus see the contents of the chamber of the first container.

2. The apparatus of claim 1 further comprising:

a plurality of further containers, each of the plurality of further containers are comprised of:
a plurality of walls
a bottom surface; and
a lid;

wherein the plurality of walls, bottom surface, and lid of each of the plurality of further containers enclose a substantially sealed chamber when each of the lids is in a closed position;

wherein when each of the lids is in an opened position there is an opening at the top of each of the chambers, wherein each of the tops of each of the chambers is opposite its corresponding bottom surface, and each of the chambers is bounded by the plurality of walls, and the bottom surface, wherein each of the lids and each set of walls of each of the plurality of further containers are substantially opaque;

and wherein the bottom surface of each of the first container and the plurality of further containers is transparent, so that an individual can see the contents inside the chamber through the bottom surface.

3. The apparatus of claim 2 further comprised of:

each of the plurality of further containers includes an attachment device for attaching each of the plurality of containers to the base; and wherein the base is comprised of a plurality of further receptacles, and wherein each attachment device of each of the plurality of further containers attaches to a corresponding receptacle on the base to temporarily attach each of the plurality of further containers to the base.

4. The apparatus of claim 2 wherein:

the first container and the plurality of further containers can be stacked on top of one another.

5. The apparatus of claim 4 wherein each of the first container and the plurality of further containers is comprised of a top portion and a bottom recess;

and wherein the top portion of one container can be inserted into the bottom recess of the other container.

6. The apparatus of claim 5 wherein the top portion of each container is of substantially same shape and size, as the bottom recess of each container such that the top portion of one container fits snugly into the bottom recess of another container.

7. The apparatus of claim 1 wherein the first container includes an attachment device for attaching the first container to a base.

8. The apparatus of claim 7 wherein the attachment device is comprised of at least one recess on at least one wall of the first container.

9. The apparatus of claim 7 wherein each of the plurality of further containers includes an attachment device for attaching each of the plurality of containers to a base.

10. The apparatus of claim 9 wherein each attachment device of each of the plurality of further containers is comprised of at least one recess on at least one wall of each of the plurality of further containers.

11. The apparatus of claim 1 wherein the base is comprised of a first receptacle, and wherein the first attachment device of the first container attaches to the first receptacle to temporarily attach the first container to the base.

12. The apparatus of claim 11 wherein the attachment device of the first container is comprised of a first recess and the first receptacle is comprised of a first protrusion; and wherein the first protrusion of the first receptacle fits into the first recess of the first container in order to temporarily attach the first container to the first receptacle.

13. The apparatus of claim 11 wherein the attachment device of the first container is comprised of a first recess and a second recess and the first receptacle is comprised of a first protrusion and a second protrusion; and wherein the first protrusion of the first receptacle fits into the first recess of the first container and the second protrusion of the first receptacle fits into the second recess of the first container in order to temporarily attach the first container to the first receptacle.

* * * * *